US012006693B2

(12) United States Patent
Abeel et al.

(10) Patent No.: US 12,006,693 B2
(45) Date of Patent: Jun. 11, 2024

(54) HEATER SLAT, SLAT ROOF COMPRISING THE SAME AND METHOD FOR MANUFACTURING THE SAME

(71) Applicant: RENSON SUNPROTECTION-SCREENS, Waregem (BE)

(72) Inventors: Bart Abeel, Waregem (BE); Joost De Frene, Waregem (BE); Kristof Lemiegre, Waregem (BE); Pieter Brabant, Waregem (BE)

(73) Assignee: Renson Outdoor NV, Kruisem (BE)

( * ) Notice: Subject to any disclaimer, the term of this patent is extended or adjusted under 35 U.S.C. 154(b) by 163 days.

(21) Appl. No.: 17/636,621

(22) PCT Filed: Sep. 10, 2020

(86) PCT No.: PCT/IB2020/058400
§ 371 (c)(1),
(2) Date: Feb. 18, 2022

(87) PCT Pub. No.: WO2021/048773
PCT Pub. Date: Mar. 18, 2021

(65) Prior Publication Data

US 2022/0341181 A1 Oct. 27, 2022

(30) Foreign Application Priority Data

Sep. 12, 2019 (BE) ..... 2019/5606

(51) Int. Cl.
*E04F 10/10* (2006.01)
*E04B 7/16* (2006.01)
(Continued)

(52) U.S. Cl.
CPC ..... *E04F 10/10* (2013.01); *E04B 7/163* (2013.01); *E04D 13/17* (2013.01); *F24C 7/043* (2013.01)

(58) Field of Classification Search
CPC ..... E04F 10/10; E04B 7/163; E04D 13/17; F24C 7/043; H05B 3/40
See application file for complete search history.

(56) References Cited

U.S. PATENT DOCUMENTS 4,143,640 A * 3/1979 Pierce ..... F24S 23/74 126/633
4,191,165 A * 3/1980 Faudarole ..... E06B 9/386 165/53

(Continued)

FOREIGN PATENT DOCUMENTS

BE 20160005365 11/2018
CN 206070911 A1 4/2017

(Continued)

*Primary Examiner* — Brian D Mattei
*Assistant Examiner* — Omar F Hijaz
(74) *Attorney, Agent, or Firm* — Dickinson Wright PLLC

(57) ABSTRACT

Heating louvre (11) for a louvred roof comprising at least two girders which extend parallel to each other and to which several louvres are rotatably connected between an open position and a closed position. The heating louvre (11) is provided with an underside (13). A slot is provided in the underside (13) for fitting a heating element (12) inside the heating louvre (11). After the heating element (11) has been fitted, the cavity (15) is at least partially sealed by it and the heating element (11) is provided to heat a position between the louvred roof and the ground surface by means of radiant heat. By using a slot in combination with a heating element (12) based on radiant heat, it is possible to heat the position between the louvred roof and the ground surface, as the heating element (12) is not fully surrounded by the heating louvre (11).

14 Claims, 11 Drawing Sheets

(51) Int. Cl.
*E04D 13/17* (2006.01)
*F24C 7/04* (2021.01)

(56) References Cited

U.S. PATENT DOCUMENTS

| | | | | | |
|---|---|---|---|---|---|
| 4,243,022 | A * | 1/1981 | Pedone | F24S 70/25 | 126/658 |
| 4,333,448 | A * | 6/1982 | Johnson | F24S 80/453 | 126/714 |
| 4,534,335 | A * | 8/1985 | Rice | F24S 20/63 | 136/246 |
| 4,655,195 | A * | 4/1987 | Boynton | E06B 9/365 | 126/633 |
| 8,338,694 | B2 * | 12/2012 | Hoffman | H01L 31/0547 | 136/246 |
| 8,640,690 | B2 * | 2/2014 | McKinzie | F24S 20/61 | 126/633 |
| 10,145,106 | B2 | 12/2018 | Abeel et al. | | |

FOREIGN PATENT DOCUMENTS

| | | | | |
|---|---|---|---|---|
| EP | 2589721 | A1 | 5/2013 | |
| EP | 2853647 | A1 | 4/2015 | |
| EP | 3059355 | A1 | 8/2016 | |
| EP | 3392426 | A1 | 10/2018 | |
| FR | 2665515 | A1 * | 1/1990 | F24F 5/00 |
| FR | 2781007 | A1 | 1/2000 | |

* cited by examiner

HEATER SLAT, SLAT ROOF COMPRISING THE SAME AND METHOD FOR MANUFACTURING THE SAME

CROSS-REFERENCE TO RELATED APPLICATIONS

This is a U.S. national stage application of PCT International Application No. PCT/IB2020/058400 filed on Sep. 10, 2020, which claims priority from BE2019/5606, filed Sep. 12, 2019, the contents of which (including all attachments filed therewith) are hereby incorporated by reference in their entirety.

FIELD OF THE INVENTION

The present invention relates to a heating louvre for a louvred roof of a ground surface, such as a terrace, garden or the like. The present invention also relates to a louvred roof comprising one or several heating louvres of this kind.

STATE OF THE ART

A louvred roof with rotatable louvres is usually deployed for covering an outdoor space, e.g. as a canopy for a terrace, veranda, pergola, pavilion, etc. in a garden. A louvred roof can also be used as a canopy in open spaces of public places, such as restaurants, hotels, bathing facilities or other structures.

A louvred roof typically comprises at least two girders which extend parallel to each other and to which several louvres are rotatably connected between an open position and a closed position. In the open position, there is a gap between the louvres and in the closed position, the louvres together form a continuous cover. By rotating the louvres between these positions, light exposure, radiant heat and ventilation to the space below the louvres can be adjusted. For example, by directing the louvres, sun and/or wind can be screened off or, conversely, let through. In other words, the louvred roof serves as protection against the sun, precipitation, wind, etc. for a space below it.

In addition, the louvres can, in their open position, are optionally provided so as to be slidable in the louvred roof; in this case they can typically be slidable between a position in which they are arranged spread across the louvred roof and a position in which they are predominantly arranged on one side of the louvred roof.

A known heating louvre for a louvred roof is meant to be part of the louvred roof and is provided with an underside, which is typically substantially flat, the heating louvre comprising a cavity in which a heating element is fitted.

A heating louvre of this kind is described in EP 3 059 355 A1. On the inside of the heating louvre, several heating means, in particular thin strips, are fitted. These heating strips are in direct contact with both the top side and the underside of the heating louvre and are held in their place by curved hooks which are integrally produced with the louvre. In the event of snowfall, hail or ice formation on the heating louvre, the heating strips make it possible for the snow, hail or ice to be melted by generating heat that heats the louvre itself via thermal conduction.

Other known heating louvres for melting snow, hail or ice are described in EP 2 853 647 A1 and EP 3 392 426 A1 and make use of a cable-shaped heating element that extends through a cavity in the heating louvre.

In practice, it has become apparent that the known heating louvres are not able to heat the space below the louvred roof, in particular near the ground surface, where people typically sit or remain. Furthermore, cable-shaped heating elements of this kind, which operate based on the Joule effect, need a sufficiently large power source for generating heat. In other words, even if it is theoretically possible to use the known heating louvres to heat the space below the louvred roof, an expensive power supply would be connected to it, which is not desired.

Therefore, for an application of this kind, use is often made of separate heating elements. These can be installed directly on the ground. Alternatively, these can be attached to the support structure of the louvred roof, for example to the girders.

A disadvantage of separate heating elements of this kind is primarily their installation. In particular, it has become apparent that, especially in the case of large louvred roofs, it is not easy to sufficiently heat the central region below them. Furthermore, installation on the ground is not ideal in view of the risk of a person coming into direct contact with the heating element.

DESCRIPTION OF THE INVENTION

It is an aim of the present invention to provide a heating louvre for a louvred roof which is able to better heat the region below the louvred roof.

This aim is achieved by the fact that the heating louvre comprises a slot in its underside along at least a part of its length, this slot providing access to said cavity, wherein, after the heating element has been fitted, the cavity is at least partially sealed by the heating element and wherein the heating element is provided to heat a position between the louvred roof and the ground surface by means of radiant heat.

By using a slot in combination with a heating element based on radiant heat, it is possible to heat the position between the louvred roof and the ground surface. This is because the heating element is not fully surrounded by the heating louvre, contrary to the known heating louvres as described in EP 3 059 355 A1, EP 2 853 647 A1 and EP 3 392 426 A1, with the result that the radiant heat is sufficiently able to heat the space below the louvred roof.

As several heating louvres of this kind can also be used in the same louvred roof and/or the position of the heating louvre can be freely chosen, it is possible to customise the heat distribution below the louvred roof.

Furthermore, in the event of a defect, the slot makes it possible for the heating element to be replaced without requiring the entire louvred roof to be dismantled.

Also, a heat source based on radiant heat is more efficient in terms of electricity compared with a heat source based on the Joule effect.

In an embodiment of the present invention, the heating louvre has a longitudinal direction and a transverse direction, wherein the slot extends in the longitudinal direction.

A slot of this kind makes it possible for an elongated heating element to be used or several heating elements to be installed next to each other so that the heating louvre can provide heat along a large part of its length.

In an embodiment of the present invention, the heating louvre has a longitudinal direction and a transverse direction, wherein the cavity is substantially symmetrical relative to the rotational axis of the heating louvre, preferably so that the cavity is positioned substantially central in the transverse direction of the heating louvre.

By installing the cavity and thus the heating element centrally in the transverse direction, it is easier to move the heating louvre between the open position and the closed position. This is because, for this move, the heating louvre rotates around its own rotational axis, which is typically also central in the transverse direction. Installing the heating element in line with the rotational axis, i.e. centrally in the transverse direction, therefore prevents problems with the balance during opening/closing of the louvred roof. Also, a non-central cavity can cause the heating louvre, in the closed position of the louvred roof, to be partially tilted under the weight of the heating element, with the result that the louvred roof contains one or several tilted louvres, which is not desired.

In an embodiment of the present invention, the heating louvre has a longitudinal direction and a transverse direction, wherein the cavity is positioned substantially central in the longitudinal direction.

By installing the cavity and thus the heating element centrally in the longitudinal direction, the girders must provide substantially the same support at both ends, which would not be the case if the heating element were near either end.

In an embodiment of the present invention, the cavity is provided with an inner edge on its inside and the heating element is provided with an outer edge that corresponds with the inner edge.

As will be described hereafter, the edges are a convenient design both for connecting the heating element to the heating louvre and for sealing the cavity in the louvre.

In a preferred embodiment of the present invention, the heating element is attached to the heating louvre by at least partially connecting the inner edge and the outer edge to each other. This connection can be established in different manners, for example by means of a bayonet fitting, by means of one or several bolts, by gluing, clamping profiles pushing the outer edge against the inner edge, etc.

It has become apparent that connections of this kind are sufficiently sturdy to keep the heating element in the correct place even during tilting of the heating louvre. Gluing has as a further advantage that it also serves immediately as seal between the inner edge and the outer edge, with the result that a separate seal can be omitted.

In a preferred embodiment of the present invention, a seal is provided between the inner edge and the outer edge. Preferably, the seal extends substantially continuously along the inner edge.

A seal of this kind contributes to preventing moisture and dirt, for example from rainfall or snow, from ending up on the inside of the heating louvre. This moisture and/or dirt could cause damage to the heating element and/or to other elements of the louvred roof. A continuous seal has the added advantage that effects of residual dripping are minimised.

In an embodiment of the present invention, the heating louvre comprises a removable part so that, after the removable part has been removed, the cavity is accessible for the purpose of installing the heating element.

The removable part makes it easier to have access to the cavity so that the heating element is easier to install compared with an integrally produced heating louvre.

In an embodiment of the present invention, the heating element comprises a housing which, on the underside, is provided with a region which lets radiant heat through, this region preferably being open.

This enhances the efficiency of the heating louvre and prevents the need for more powerful, and thus larger and heavier, heating elements for bringing the space below the louvred roof to the desired temperature.

In an embodiment of the present invention, the heating louvre is provided with coupling means on one of its top ends for working together with corresponding coupling means on the girder of the louvred roof to supply electricity to the heating element.

Coupling means of this kind make it possible to have a power supply without requiring a cabling to be visible externally on the heating louvre. This is because an external cable could cause jamming during tilting of the louvres and is of course also not aesthetically desired.

In an embodiment of the present invention, the heating louvre is formed from an extruded profile.

Extruding is a known manner of producing profiles and is typically used to produce longitudinal profiles. Therefore, this embodiment makes use of the advantages of extruding to produce the heating louvre.

The aim of the present invention is also achieved by a louvred roof for a ground surface, such as a terrace, garden or the like, the louvred roof comprising: a support structure with at least two girders which extend parallel to each other along a longitudinal direction; and a plurality of louvres which are installed next to each other in said longitudinal direction and which extend in a transverse direction which is substantially perpendicular to the longitudinal direction, each louvre having two ends located opposite each other which are connected to a respective one of the girders, one or several of the louvres being formed by a heating louvre such as described above. In particular, the louvres, and preferably also the one or several heating louvres, are rotatable between an open position in which a gap is present between the louvres and a closed position in which the louvres form a continuous cover.

As the louvred roof makes use of one or several of the louvres as described above, the louvred roof has the same advantages as the heating louvre described above.

In an embodiment of the present invention, the louvres, at one end, are provided with a louvre spindle and the one or several heating louvres, at one end, are provided with a heating louvre spindle which has a larger diameter than the louvre spindle and in which a central passage is provided for a power cable, wherein at least one girder is provided with a plurality of substantially identical openings, wherein the louvre spindle of the louvres is attached into one of the openings by means of a bearing and wherein the heating louvre spindle of the heating louvres is attached into one of the openings by means of a further bearing, the further bearing being thinner than the bearings.

This combination of a wider louvre spindle and a thinner bearing makes it possible for a power cable to be provided on the inside of the louvre without requiring adjustments to be made to the openings in the girder. In other words, the bearings (i.e. the bearings of a standard louvre) and the further bearings (i.e. the bearings of a heating louvre) have the same external diameter, but the internal diameter of the further bearing is larger than that of the bearings.

The aim of the present invention is also achieved by a method for producing a heating louvre as described above, the method comprising the following steps:

extruding a profile to obtain an extruded profile;

cutting the extruded profile to the desired length;

milling in the underside of the extruded profile to obtain the slot; and fitting the heating element into the cavity.

As this method results in the heating louvre described above, this method has the same advantages.

BRIEF DESCRIPTION OF THE DRAWINGS

The invention will be further explained in detail hereafter using the following description and the attached drawings.

EMBODIMENTS OF THE INVENTION

Figure 1:
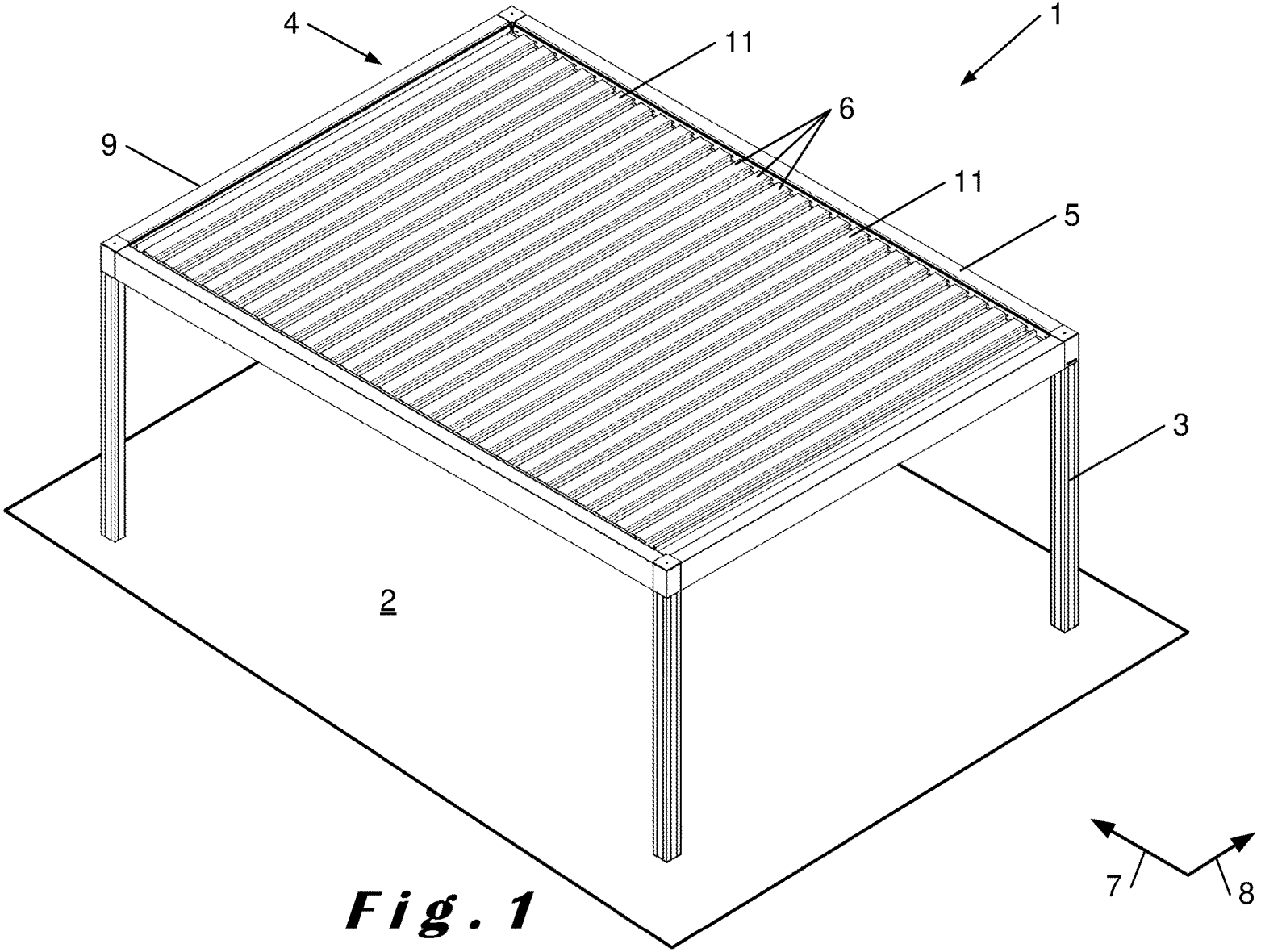
FIG. 1 shows a perspective view of a louvred roof.

The present invention will be described hereafter using specific embodiments and with reference to certain drawings, although the invention is not restricted thereto and is only defined by the claims. The drawings shown here are only schematic representations and are not restrictive. In the drawings, the dimensions of certain components may be shown enlarged, which means that the components in question are therefore not shown to scale, for illustrative purposes only. The dimensions and the relative dimensions do not necessarily correspond with the actual practical embodiments of the invention.

Furthermore, terms such as "first", "second", "third", and the like in the description and in the claims are used to distinguish between similar elements and not necessarily to indicate a sequential or chronological order. The terms in question are interchangeable in the appropriate circumstances, and the embodiments of the invention can operate in other orders than those described or illustrated here.

Moreover, terms such as "top", "base", "above", "below", and the like in the description and in the claims are used for descriptive purposes. The terms thus used are interchangeable in the appropriate circumstances, and the embodiments of the invention can operate in orientations other than those described or illustrated here.

The term "comprising" and derived terms, as used in the claims, must not be interpreted as being restricted to the means that are mentioned in each case thereafter; the term does not exclude other elements or steps. The term must be interpreted as a specification of the mentioned characteristics, whole numbers, steps, or components being referred to, without, however, excluding the presence or addition of one or more associated characteristics, whole numbers, steps, or components, or groups thereof. The scope of an expression such as "a device comprising the means A and B" is therefore not only restricted to devices which purely consist of components A and B. On the contrary, what is meant is that in respect of the present invention, the only relevant components are A and B.

FIG. 1 illustrates a canopy 1 for a ground surface 2, for example a terrace or garden. The canopy 1 comprises four support columns 3 to which the louvred roof 4 is attached. The louvred roof 4 comprises two girders 5 to which several louvres 6 are rotatably connected, in particular using louvre spindles (not shown), between an open position and a closed position. FIG. 1 illustrates the closed position in which the louvres 6 together form a substantially continuous cover. In the open position (not shown), there is a gap between the louvres 6.

As used further herein, the term "longitudinal direction of the louvred roof" 7 means the direction along which the girders 5 extend as indicated by arrow 7 in FIG. 1.

As used further herein, the term "transverse direction of the louvred roof" 8 means the direction along which the louvres 6 extend as indicated by arrow 8 in FIG. 1. The longitudinal direction and the transverse direction of the louvred roof are substantially perpendicular to each other.

Figure 2:
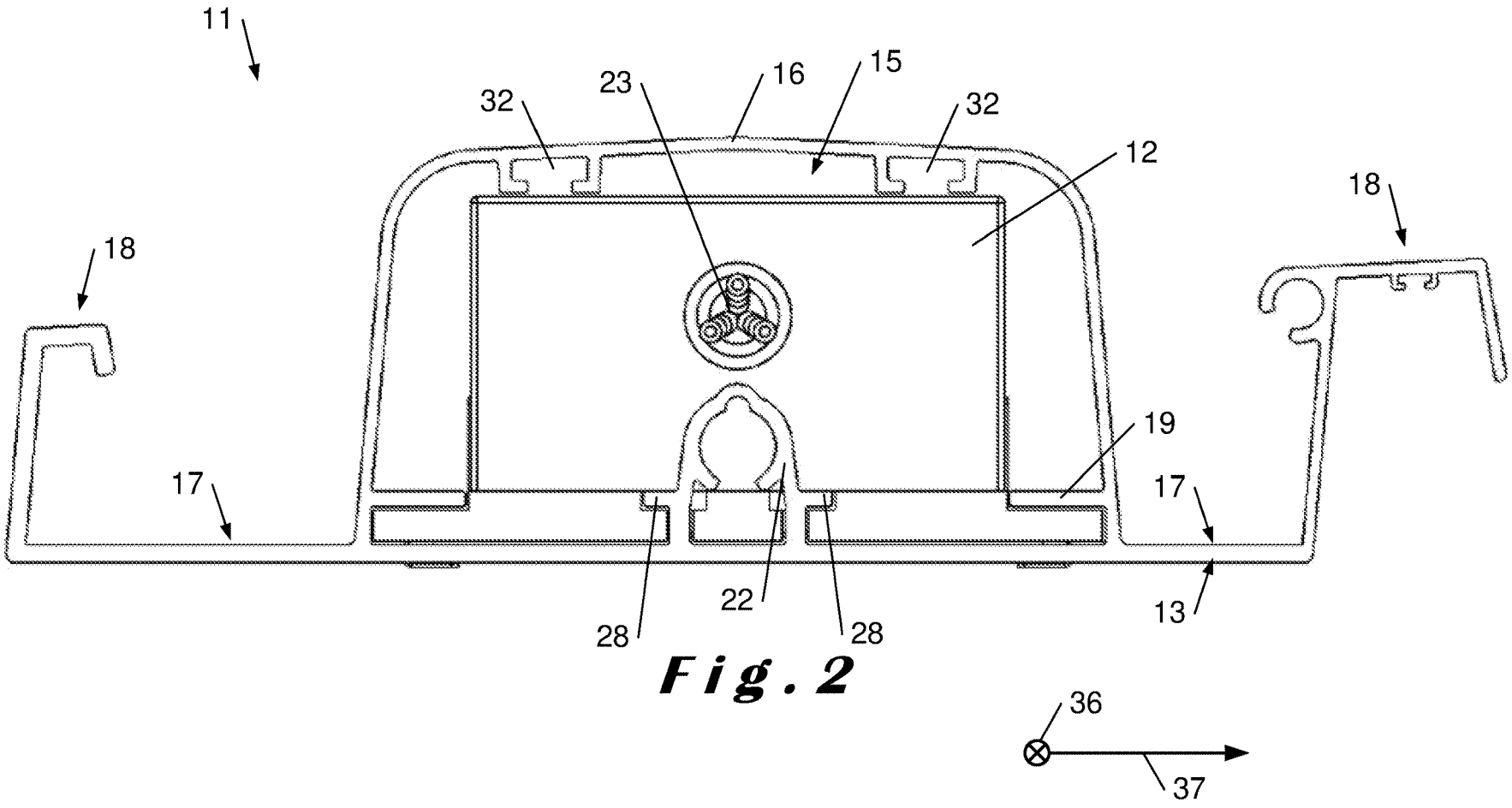
FIG. 2 shows a side view at the top end of a heating louvre according to the present invention.
Figure 3:
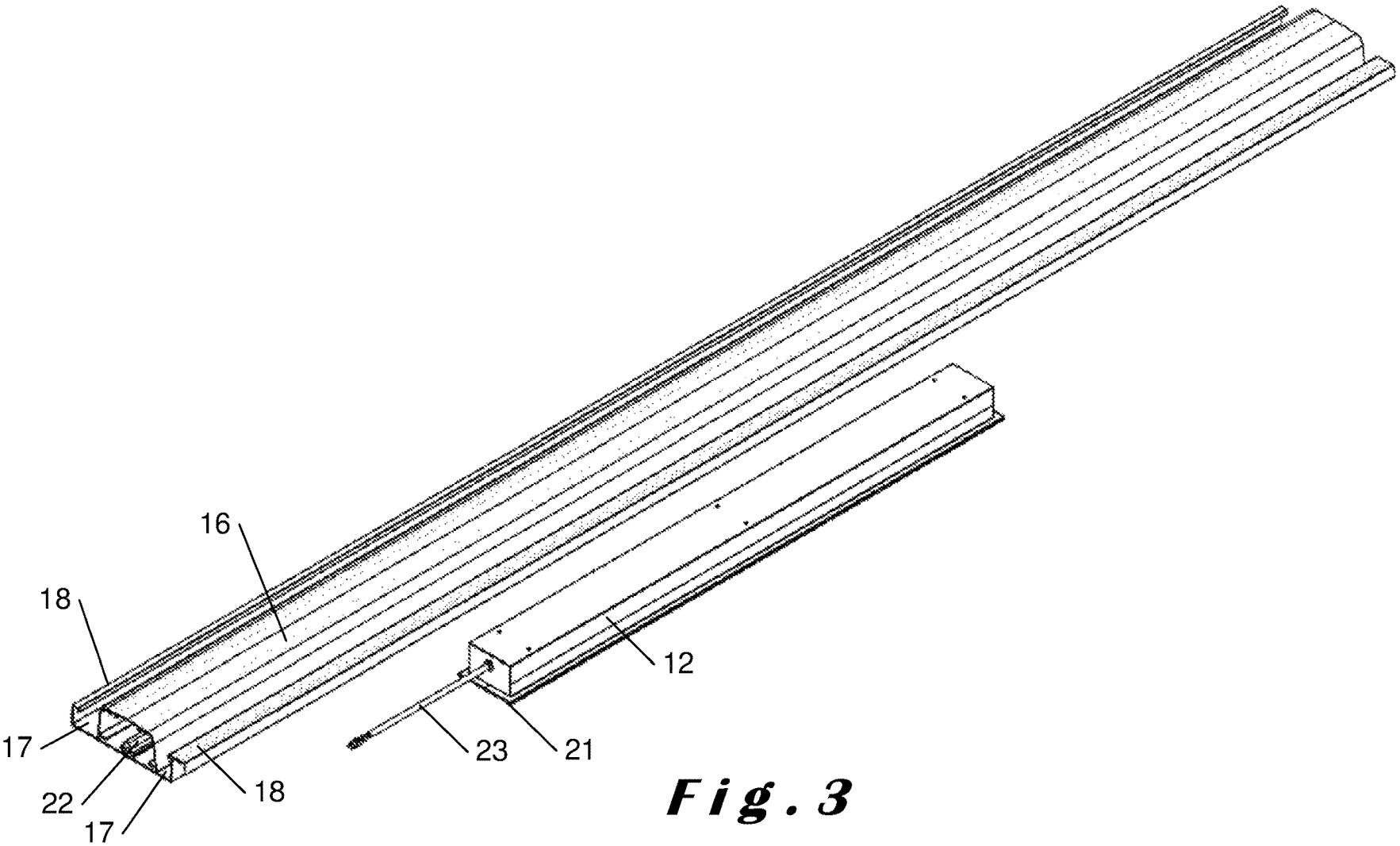
FIG. 3 shows a perspective view of the heating louvre from FIG. 2 in a disassembled view from the top side.

As used further herein, the term "longitudinal direction of a louvre" 36 means the direction along which the louvres 6 extend as indicated by arrow 36 in FIG. 2.

As used further herein, the term "transverse direction of a louvre" 37 means the direction that is substantially perpendicular to the longitudinal direction of a louvre as indicated by arrow 37 in FIG. 2.

In the embodiment shown, the louvred roof 4 is further provided with two beams 9 which extend in the transverse direction 8 and connect the supports 3 to each other. These beams 9 form the ends of the louvred roof 4 in the longitudinal direction 7 and typically contribute to the sturdiness of the louvred roof 4. The beams 9 can for example be formed by non-tiltable louvres 6. However, the beams 9 are optional. This is because it is also possible to form the transverse ends of the louvred roof 4 using louvres 6 which do tilt.

By rotating the louvres 6 between the open position and the closed position, light exposure, radiant heat and ventilation to the space below the louvres can be adjusted. In the open position, there is a gap between the louvres 6 through which, for example, air can be brought into the space below or can exit this space below. In the closed position, the louvres 6 form a closed canopy with which the space below can be screened off from, for example, wind and/or precipitation, such as rain, hail or snow. For drainage of precipitation, the louvres 6 are typically arranged sloping down towards either girder 5.

The girders 5 can be produced from various materials, such as aluminium, plastic, wood, etc. In the embodiment shown, the girders 5 are embodied in hollow form.

The louvres 6 can also be produced from various materials, such as aluminium or plastic. Filler elements made from, for example, polycarbonate, glass, wood, etc. may be used to at least partially fill the hollow louvres 6, for example to obtain a different appearance of the louvre. Preferably, the louvres 6 are produced by means of an extrusion process, as described hereafter with reference to FIGS. 8A to 8E, to obtain an extrusion profile which can be cut to the desired length for the louvres 6.

In an embodiment, the louvres 6 can in addition, in their open position, are optionally provided so as to be slidable in the louvred roof 4, in order to further increase the adjustment options in respect of light exposure, radiant heat and ventilation.

As already described, the louvred roof 4 can generally be deployed for covering an outdoor space, as well as for an indoor space. It will therefore be appreciated too that the girders 5 can also be attached to structures other than exclusively to support columns 3, for example a wall.

Figure 7:
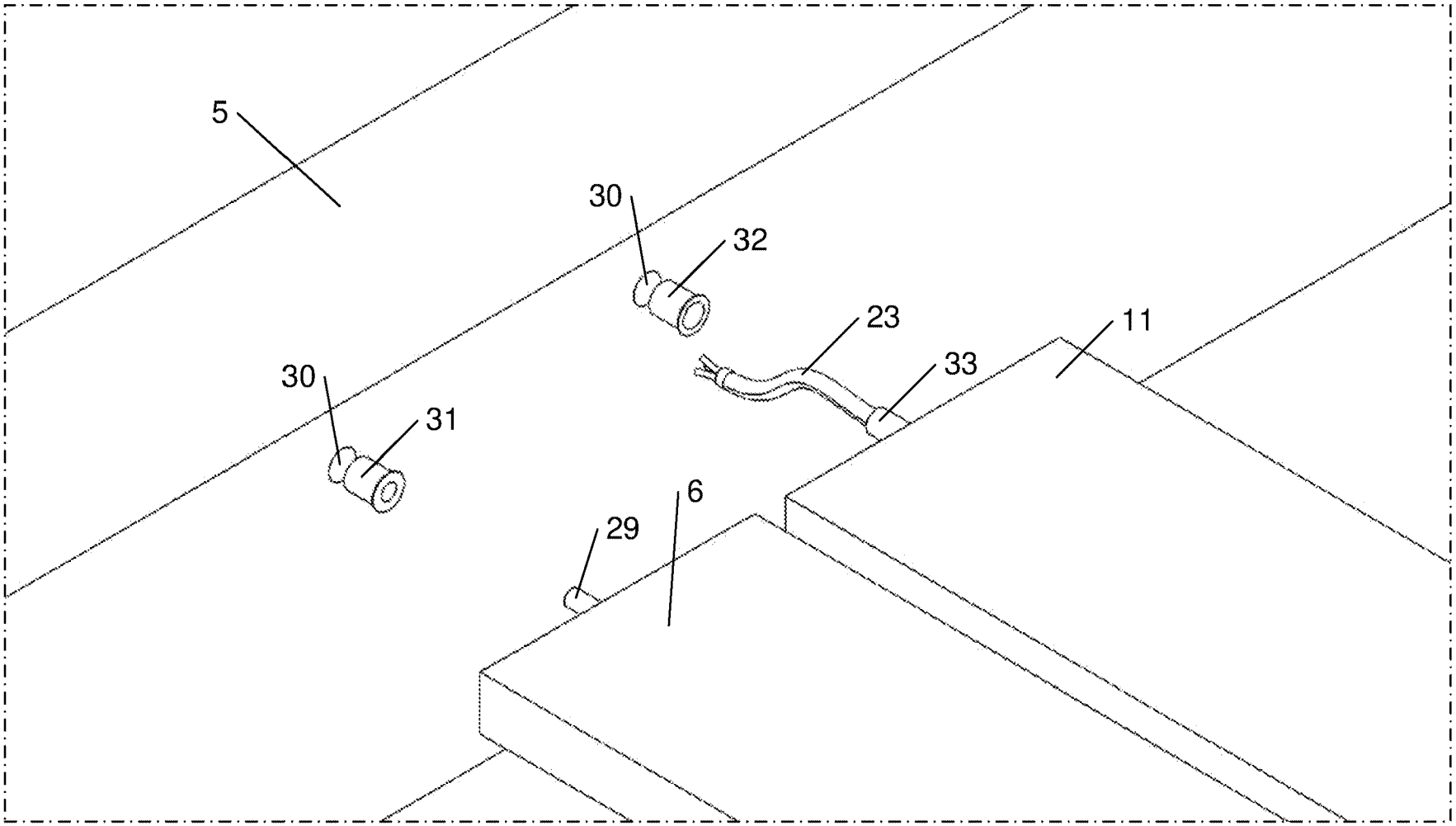
FIG. 7 shows a detail of the connection of a heating louvre and an ordinary louvre on a girder of the louvred roof from FIG. 1.

Details in respect of attaching a louvre 6 to the girders 5 are known to a person skilled in the art. Details can for example be found in patent application BE 2016/5365 and are also shown in FIG. 7. The attachment typically makes use of a spindle (not shown) which runs through the louvre 6 and connects to an end piece (not shown) provided with a louvre spindle 29 (shown in FIG. 7) which grips onto an opening 30 (shown in FIG. 7) in the girders 5, this opening 30 being provided with a bearing 31. It will be clear that other connections, for example without an end piece, in which case the louvre spindle is directly present on the louvre, are possible too.

In the louvred roof 4 according to the present invention, one or several—two in the embodiment shown—heating louvres 11 are installed between the other louvres 6. A heating louvre 11 according to the invention shall be described in more detail hereafter with reference to FIGS. 2 to 8. A heating louvre 11 differs from the other louvres 6 in that a heating element 12 is provided inside the louvre 11. This heating element 12 operates based on radiant heat and is able to heat the present below the louvred roof 4.

By integrating the heating element 12 into a louvre 11, there is less distance between the heat source and the location to be heated compared with a heating element attached to the girders 5 or the beams 9. This also means that a less powerful, and thus typically more energy-efficient, cheaper and smaller heating element 12 can be used to achieve the same temperature below the louvred roof 4.

A more uniform heat distribution can likewise be obtained compared with a heating element attached to the girders 5 or the beams 9, as several heat sources, i.e. several heating louvres 11, can be provided in the louvred roof 4. In an embodiment, the spacing between two subsequent heating louvres is determined based on, among other things, the capacity and the efficiency of the heating element 12 and the height of the louvred roof 4. Preferably, there is a spacing of 1.2 to 1.5 metres between two subsequent heating louvres 11, which provides the desired uniform heat distribution. A spacing of this kind can for example be obtained by providing one heating louvre 11 for every four or five louvres 6 in the louvred roof 4. It will be clear that other heat distributions are possible too, for example with the emphasis on the central region below the louvred roof 4 or slightly more emphasis on the regions near the edges of the louvred roof 4.

There is optionally an additional difference between a heating louvre 11 and an ordinary louvre 6, as it is possible to place the heating louvre 11 into a canopy 1 only in a closed position. In other words, the heating louvre 11 is in this case not rotatable relative to the canopy 1 and only the ordinary louvres 6 are rotatable.

FIG. 2 shows a side view at the top end of a heating louvre 11. The louvre 11 is provided with a flat underside 13 in which an elongated slot 14 (see FIG. 4) is made. This slot 14 provides access to the cavity 15 formed by a chamber 16. The design of the chamber 16 is primarily determined by the volume required in the cavity 15 for installing the heating element 12. Just like in the case of an ordinary louvre 6, the heating louvre 11 is provided with drainage surfaces 17 along the chamber 16. Precipitation can be drained via these surfaces 17 in the closed position of the louvred roof 4. The design of the ends 18 is substantially identical to a known louvre 6 and is of minor importance for the present invention.

Figure 4:
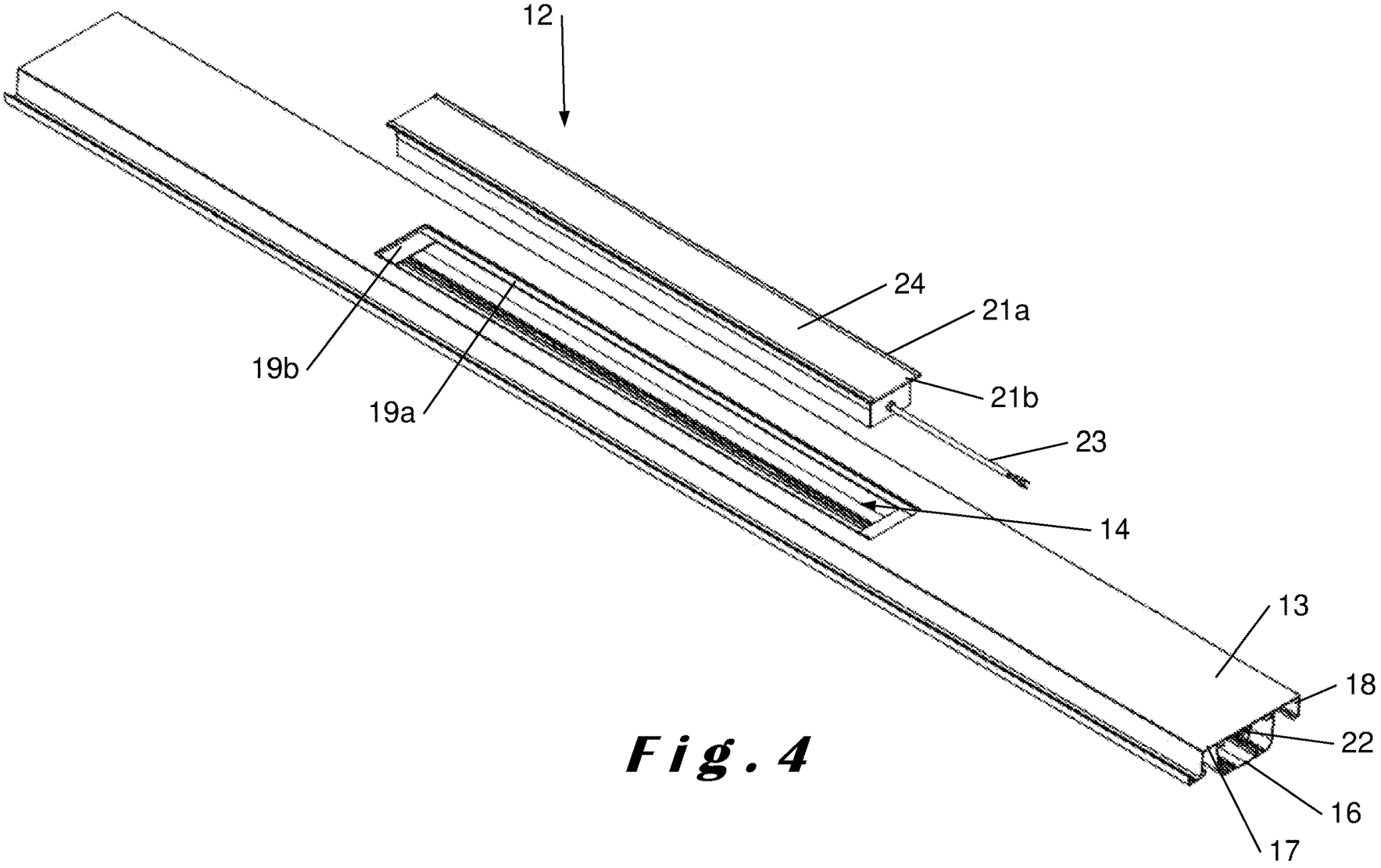
FIG. 4 shows a perspective view of the heating louvre from FIG. 2 in a disassembled view from the underside.

In the embodiment shown, the cavity 15 is provided with an inner edge 19 which consists of two transverse parts 19*b* and two longitudinal parts 19*a* as shown in FIG. 4. The heating element 12, or its housing, is provided with a corresponding outer edge 21 with transverse parts 21*b* and longitudinal parts 21*a* as shown in FIG. 4. The inner edge 19 and the outer edge 21 have a corresponding shape and primarily serve to seal the cavity 15 but can also be used to attach the heating element 12 into the cavity 15.

In the embodiment shown, the sealing of the cavity 15 is achieved by fitting a seal 25 (shown in FIG. 6) between the inner edge 19 and the outer edge 21. The seal can be produced from a plurality of materials, for example silicone, in particular heat-resistant silicone, rubber, thermoplastics or fluoroplastic with carbon added and is preferably sufficiently flexible to be at least partially compressed between the edges 19, 21, which enhances the quality of the seal. The seal can be an integrally formed rectangle but can also consist of individual strips between each edge part. It is advantageous if the seal is present between all edge parts as, in this manner, effects of residual dripping, where water would penetrate into the cavity 15 during a rain shower with the result that this water would leak out of the cavity 15 at a later time, are fully prevented. However, it is also possible for the seal 25 to be interrupted locally or for certain edge parts, for example the transverse parts 19*b*, 21*b*, to not be provided with a seal.

The heating element 12 and the heating louvre 11 can be attached to each other in different manners. Possible manners are by gluing them to each other, by means of bolts or by means of a bayonet fitting. An attachment of this kind causes the edges 19, 21 to lie on top of each other, with the result that the seal 25 ensures good a sealing of the cavity 15. In the embodiment shown, the chamber 16 is provided with support elements 32 on the inside onto which the heating element 12 can be hung. This ensures a connection that is not visible from the outside of the louvre 11, which is desired. In an alternative embodiment, the support elements 32 are absent and the edges 19, 21 can be directly attached to each other.

Fitting the heating element 12 means that it is not possible for the spindle to run through the louvre. Therefore, in the case of the heating louvre 11, a spindle is provided on each top end of the louvre 11. The spindles (not shown) are attached into the fasteners 22.

In the embodiment shown, the heating element 12 comprises a housing with the outer edge 21 thereon. In the housing, there is a heat source (not shown). In the figures, the heat source is an electric heat source as is apparent from power cable 23 coming out of the housing. This power cable 23 subsequently continues through the louvre 11 up to near either top end of the louvre 11 as shown in FIG. 7. At this end, the power cable 23 runs through a hollow louvre spindle 33. Just like in the case of an ordinary louvre 6, an opening 30 is provided in the girder 5. As the power cable 23 is required to run through the louvre spindle 33 for a heating louvre 11, the louvre spindle 33 has a larger diameter than the louvre spindle 29 of an ordinary louvre 6. In order that the holes 30 in the girder 5 can all retain the same diameter, which makes it possible for the heating louvre 11 to be mounted in any place, a thinner bearing 32 is used in the louvre spindle 33 compared with bearing 31 in the louvre 6 with louvre spindle 29.

In summary, the combination of a wider louvre spindle and a thinner bearing makes it possible for a power cable to be provided on the inside of the louvre without requiring adjustments to be made to the openings in the girder. Although the power cable 23 described here is with reference to a heat source, this same configuration of connection to the girder can be used for the power supply for other appliances. In such a manner, the power cable 23 is also not visible on the outside of the canopy 1.

In general, one of the top ends of the louvre 11 is provided with coupling means 32, 33 which work together with corresponding coupling means 30 on the girder 5 of the louvred roof 4 to supply electricity to the heating element 12.

Preferably, the heat source is an infra-red heater, but other possibilities are known to the person skilled in the art.

Figure 5:
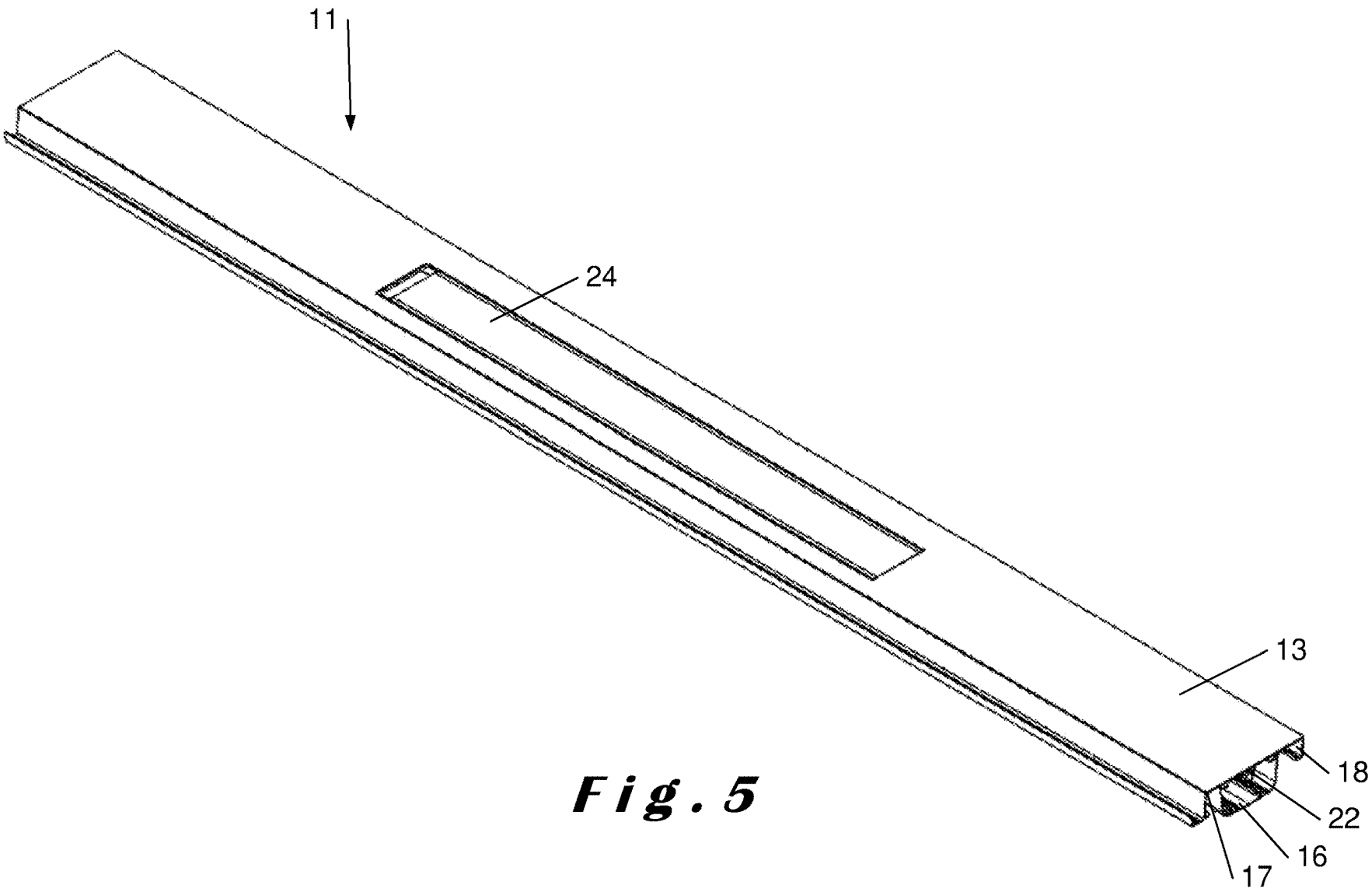
FIG. 5 shows a view that is the same as FIG. 4 with the heating element fitted in the heating louvre.
Figure 6:
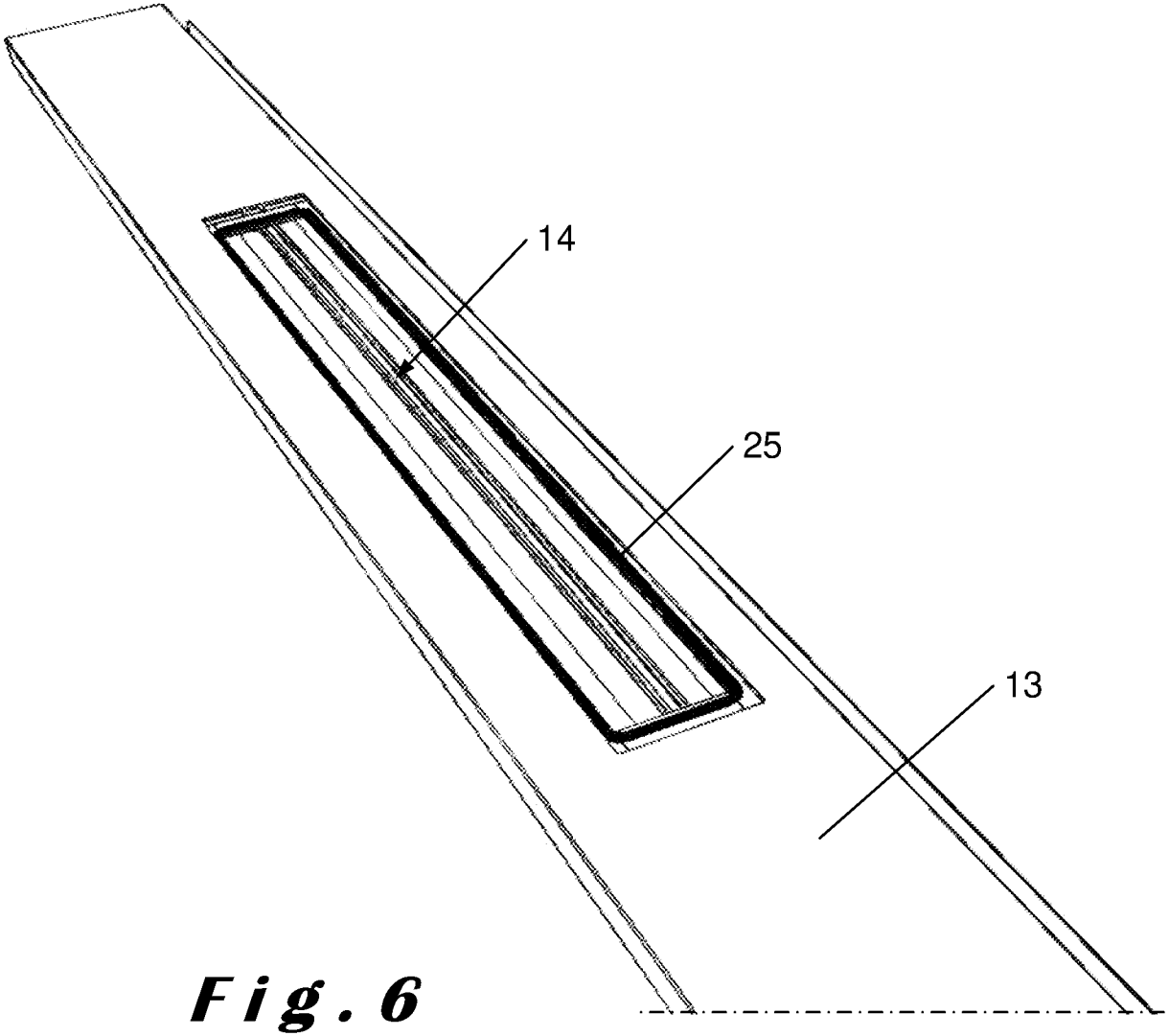
FIG. 6 shows a detail of FIG. 4 in which the seal is shown.

On the underside, the housing is provided with an opening 24 shown in FIGS. 4 and 5. This opening 24 easily lets the radiant heat generated by the heat source through, with the result that there are as few obstacles as possible to the transport of heat to the space below. Alternatively, a cover, for example a glass panel or a metal grid, can be provided which lets radiant heat through. This cover has in this case the advantage that there is an additional sealing of the cavity 14, with the result that the seal between the edges 19, 21 is not required to be present.

As shown in FIG. 2, the chamber 16 is in the centre of the louvre 11 viewed in the transverse direction 37. By installing the chamber 16 and the cavity 15 and thus the heating element 12 centrally in the transverse direction 37, the weight of the heating element 12 is substantially centrally distributed relative to the spindle, which fits in the fasteners 22. In other words, the heating element 12 is positioned such that, in the closed position of the louvred roof 4, the louvre 11 is substantially in balance, i.e. there is no rotation which is induced by gravity on the heating element 12. As already described above, this prevents balance problems and undesired tilting.

As shown in FIGS. 4 and 5, the slot 14 is in the centre of the louvre 11 viewed in the longitudinal direction 36. By installing the slot 14 and thus the heating element 12 centrally in the longitudinal direction 36, the girders must provide substantially the same support at both ends, which would not be the case if the heating element were near either end.

Figure 8A:
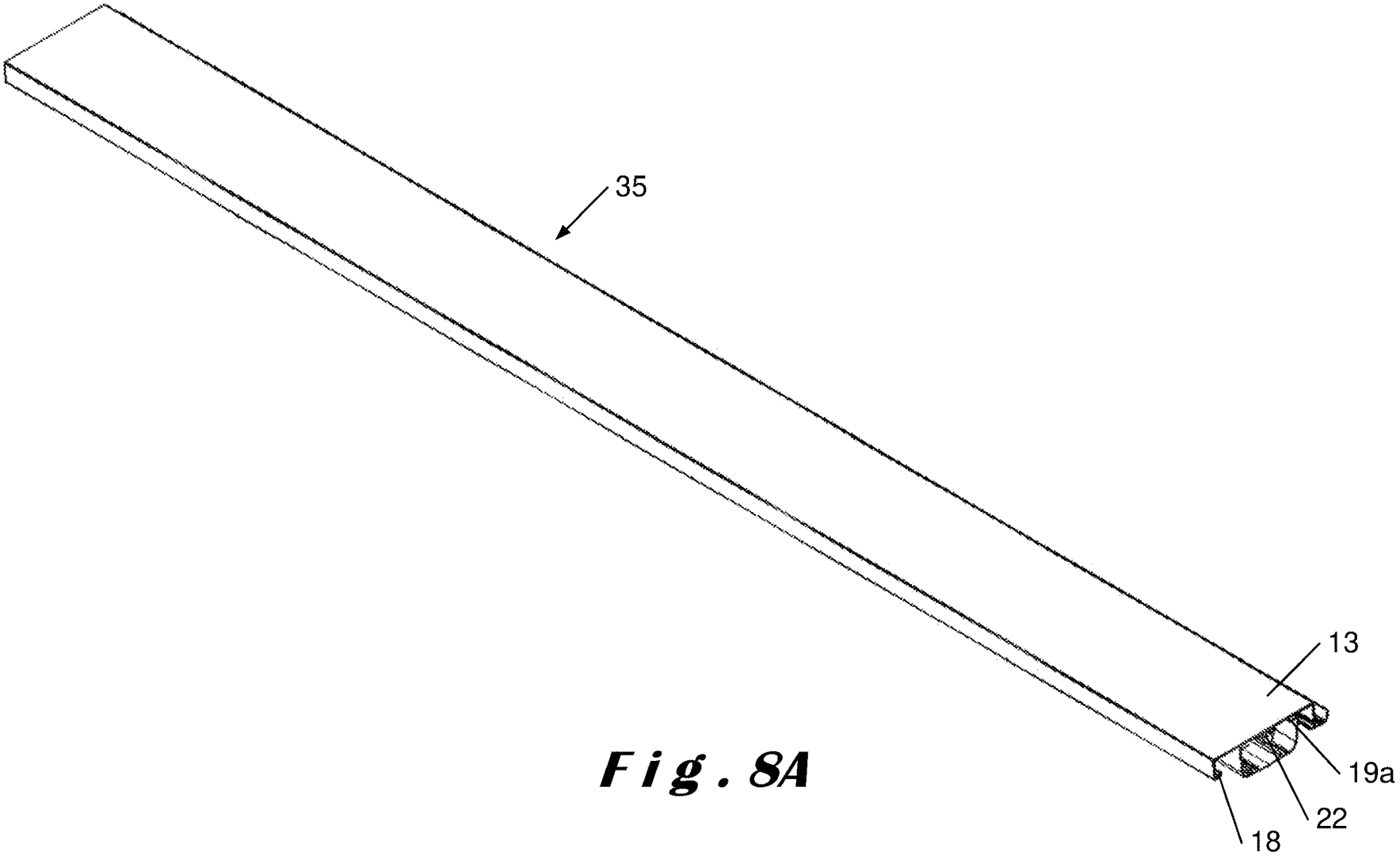
FIGS. 8A to 8E illustrate various steps in the production of the heating louvre from FIG. 2.
Figure 8B:
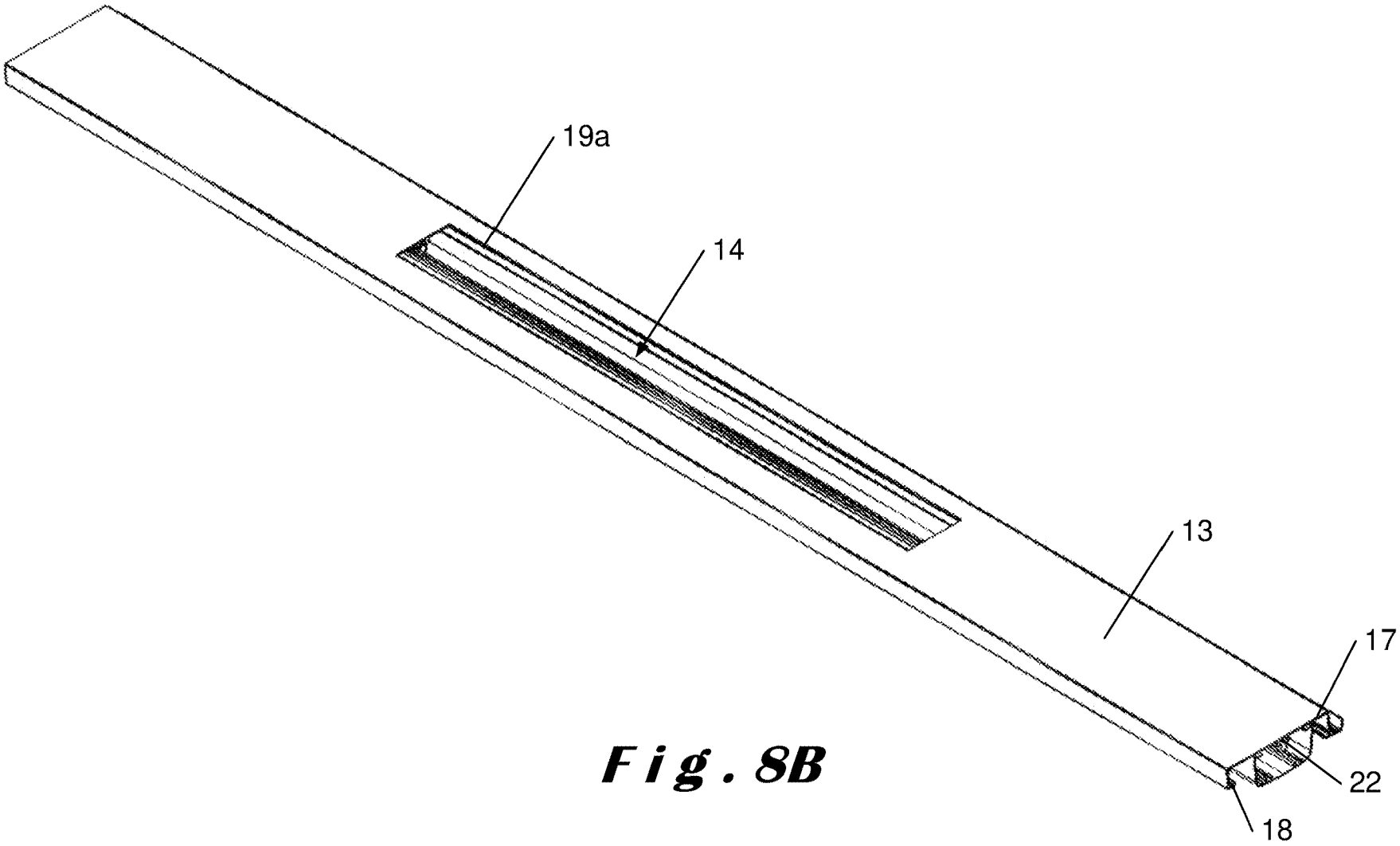
Figure 8C:
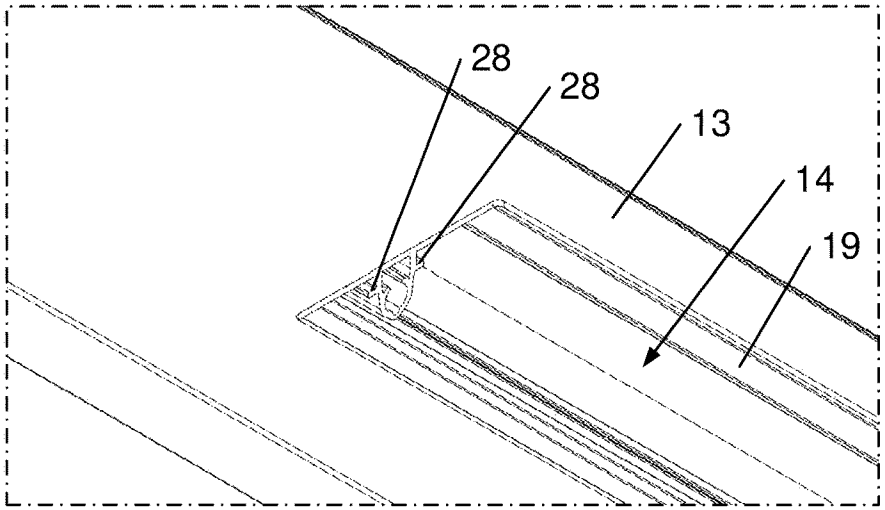
Figure 8D:
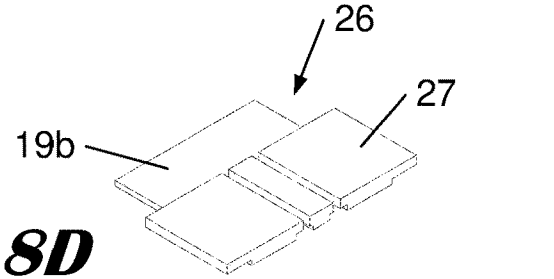
Figure 8E:
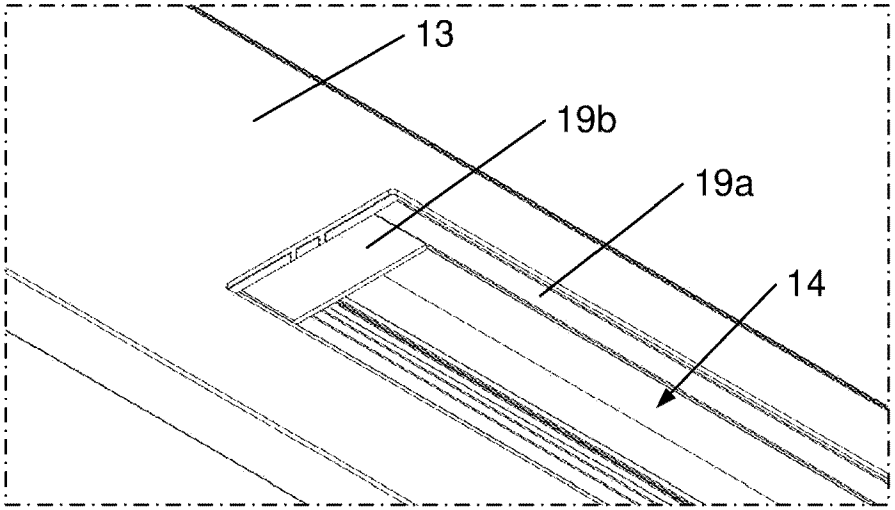

A method for producing the louvre 11 will be described with reference to FIGS. 8A to 8E. The louvre 11 is typically produced by means of an extrusion process. The profile obtained by the extrusion process is cut to the desired length afterwards. An extrusion profile 35 of this kind is shown in FIG. 8A. The transverse parts 19*b* of the inner edge 19 are also produced during the extrusion process. In a following phase, the slot 14 is made as shown in FIGS. 8B and 8C. Preferably, the slot 14 is made by means of a milling process, wherein the fasteners 22 for the spindle are also removed in order to make space for the heating element 12. In the following step (as shown in FIGS. 8D and 8E), an element 26 is inserted at each of the transverse ends of the slot 14. The element 26 comprises an attachment part 27 that is slidable on the fasteners 22 for the spindle, in particular on edges 28 thereof as shown in FIGS. 2 and 8C. The other side of element 26 forms the transverse part 19*b* of the inner edge 19.

Figure 9:
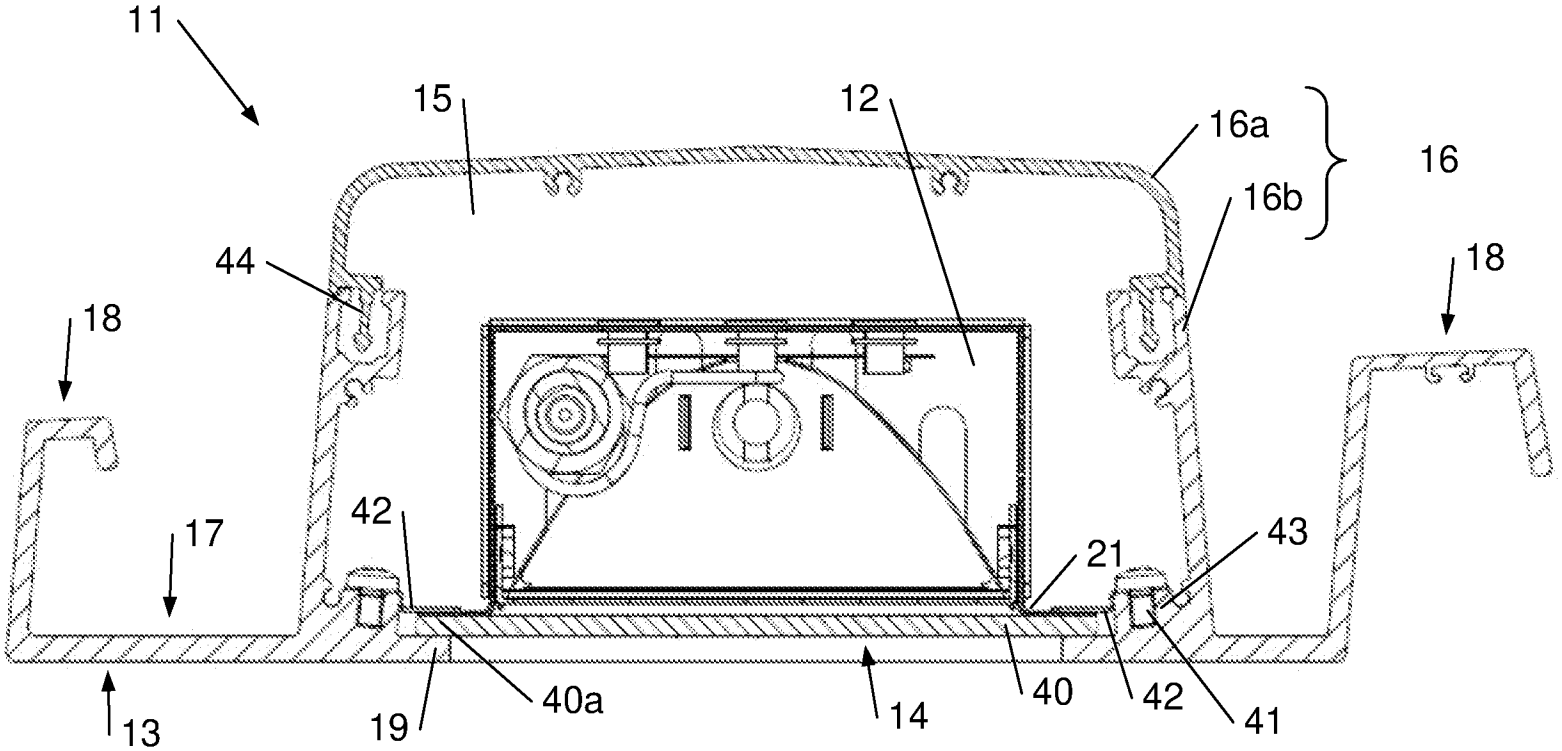
FIG. 9 shows a cross section through a second embodiment of a heating louvre according to the present invention.

FIG. 9 shows a cross section through a second embodiment of a heating louvre 11 according to the present invention. Hereafter, the differences are primarily discussed compared with the embodiment shown in FIGS. 2 to 8E.

The louvre 11 is provided with a flat underside 13 in which an elongated slot 14 is made. This slot 14 provides access to the cavity 15 formed by a chamber 16. The design of the chamber 16 is primarily determined by the volume required in the cavity 15 for installing the heating element 12.

A first difference is that, in this embodiment, the chamber 16 comprises two parts 16*a*, 16*b*, the top part 16*a* being removable relative to the lower part 16*b*. By being able to remove a part 16*a* from the chamber 16, it is possible to insert the heating element 12 via the top side of the louvre 11. Installing the heating element 12 in this manner is easier. For connecting the parts 16*a*, 16*b*, a pin connection 44 is provided in the embodiment shown. However, it should be clear that the person skilled in the art knows others for connecting two profiles 16*a*, 16*b* to each other.

A second difference is that the inner edge 19 is formed by the circumferential edge of the slot 14. The heating element 12, or its housing, is provided with a corresponding outer edge 21. In this embodiment, there is also a cover 40 (for example a glass panel or a metal grid) present that lets radiant heat through. The outer circumferential edge 40*a* of the cover 40 is placed between the inner edge 19 and the outer edge 21. One or several seals (not shown) can be provided between the inner edge 19 and the cover 40 and/or between the outer edge 21 and the cover 40.

The heating element 12 is attached to the louvre 11 by means of bolts 41, clamping profiles 42 and bolt ducts 43. More specifically, there are a number of bolt ducts 43 on the inside of the lower chamber part 16*b*, i.e. inside the cavity 15. These bolt ducts 43 are used for the installation of corresponding bolts 41 so that clamping profiles 42 can be attached to the lower chamber part 16*b*. In particular, the bolts 41 extend through a first end of the clamping profiles 42 so that these ends are fixed relative to the bolt ducts 43. The clamping profiles 42 press with their other end against the top side of the outer edge 21 of the heating element 12 such that the outer edge 21 pushes against the inner edge 19.

Furthermore, it is also possible to omit the cover 40 altogether or to provide this fully in the slot 14 so that the underside 13 of the louvre 11 has a substantially flat appearance.

Although certain aspects of the present invention have been described in respect of specific embodiments, it is clear that these aspects can be implemented in other forms within the scope of protection as defined by the claims.

The invention claimed is:

1. A louvred roof for a ground surface, the louvred roof comprising:

a support structure with at least two girders extending parallel to each other along a longitudinal direction;

a plurality of louvres installed next to each other viewed in said longitudinal direction and extending in a transverse direction substantially perpendicular to the longitudinal direction, each louvre of said plurality of louvres having two ends located opposite each other and connected to a respective one of the two girders, wherein the louvres are rotatably connected to the at least two girders between an open position and a closed position in which the louvres form a continuous cover, wherein one or more of the louvres is a heating louvre comprising:

an underside;

a cavity;

a heating element fitted in said cavity; and a slot in said underside extending along at least a part of a length of said heating louvre, said slot providing access to said cavity, wherein, after the heating element is fitted in said cavity, the cavity is at least partially sealed by the heating element, and wherein the heating element is provided to heat a position between the louvred roof and the ground surface by radiant heat.

2. The louvred roof according to claim 1, wherein an inside of the cavity comprises an inner edge and the heating element comprises an outer edge corresponding with the inner edge.

3. The louvred roof according to claim 2, further comprising a seal provided between the inner edge and the outer edge.

4. The louvred roof according to claim 3, wherein the seal extends substantially continuously along the inner edge.

5. The louvred roof according to claim 2, wherein the heating element is attached to the heating louvre by at least partially connecting the inner edge and the outer edge to each other.

6. The louvred roof according to claim 5, wherein the inner edge and the outer edge are at least partially connected by at least one of: a bayonet fitting, one or more bolts, gluing, and one or more clamping profiles pushing the outer edge against the inner edge.

7. The louvred roof according to claim 1, further comprising a removable part, wherein, after the removable part is removed, the cavity is accessible for installing the heating element.

8. The louvred roof according to claim 1, wherein the cavity is substantially symmetrical relative to a rotational axis of the heating louvre, whereby the cavity is positioned substantially central in a longitudinal direction of the heating louvre.

9. The louvred roof according to claim 1, wherein the heating louvre comprises a longitudinal direction and a transverse direction, wherein the cavity is positioned substantially central in the transverse direction.

10. The louvred roof according to claim 1, further comprising a housing including the underside, wherein the underside comprises a region letting said radiant heat through said region.

11. The louvred roof according to claim 1, further comprising:

at least one top end; and a coupling means configured on the at least one top end in working communication with a corresponding coupling means on at least one of the two girders of the louvred roof to supply electricity to the heating element.

12. The louvred roof according to claim 1, wherein the heating louvre is formed from an extruded profile.

13. The louvred roof according to claim 1, wherein the louvres, at one end, comprise a louvre spindle and the one or more of the heating louvres, at one end, comprises a heating louvre spindle which has a larger diameter than the louvre spindle and in which a central passage is provided for a power cable, wherein at least one of the two girders is provided with a plurality of substantially identical openings, wherein the louvre spindle of the louvres is attached into one of the openings by a bearing, and wherein the heating louvre spindle of the one or more heating louvres is attached into one of the openings by a further bearing, the further bearing being thinner than the bearing.

14. A louvred roof for a ground surface, the louvred roof comprising:

a support structure with at least two girders extending parallel to each other along a longitudinal direction;

a plurality of louvres installed next to each other viewed in said longitudinal direction and extending in a transverse direction substantially perpendicular to the longitudinal direction, each louvre of said plurality of louvres having two ends located opposite each other and connected to a respective one of the two girders, wherein one or more of the louvres is a heating louvre comprising:

an underside;

a cavity;

a heating element fitted in said cavity; and a slot in said underside extending along at least a part of a length of said heating louvre, said slot providing access to said cavity, wherein, after the heating element is fitted in said cavity, the cavity is at least partially sealed by the heating element, and wherein the heating element is provided to heat a position between the louvred roof and the ground surface by radiant heat, wherein the louvres, at one end, comprise a louvre spindle and the one or more of the heating louvres, at one end, comprises a heating louvre spindle which has a larger diameter than the louvre spindle and in which a central passage is provided for a power cable, wherein at least one of the two girders is provided with a plurality of substantially identical openings, wherein the louvre spindle of the louvres is attached into one of the openings by a bearing, and wherein the heating louvre spindle of the one or more heating louvres is attached into one of the openings by a further bearing, the further bearing being thinner than the bearing.

* * * * *